US009585535B2

(12) United States Patent
Morgan et al.

(10) Patent No.: US 9,585,535 B2
(45) Date of Patent: Mar. 7, 2017

(54) VACUUM SUCTION BASE DEVICE WITH SWIVEL COUPLING HAVING ELECTRIC MOTOR INSIDE A WHEEL AND GAPS FOR VISIBILITY

(71) Applicant: Techtronic Floor Care Technology Limited, Road Town (VG)

(72) Inventors: Jeff Morgan, Pineville, LA (US); Dennis Lamb, Cookeville, TN (US); Steven Myers, Buffalo Valley, TN (US); George V. Hibbs, Cookeville, TN (US)

(73) Assignee: Techtronic Floor Care Technology Limited, Tortola (VG)

( * ) Notice: Subject to any disclaimer, the term of this patent is extended or adjusted under 35 U.S.C. 154(b) by 716 days.

(21) Appl. No.: 13/743,298

(22) Filed: Jan. 16, 2013

(65) Prior Publication Data

US 2014/0196250 A1 Jul. 17, 2014

(51) Int. Cl.

| | |
|---|---|
| ***A47L 5/30*** | (2006.01) |
| ***A47L 11/40*** | (2006.01) |
| ***A47L 9/04*** | (2006.01) |
| ***A47L 5/28*** | (2006.01) |
| ***A47L 9/02*** | (2006.01) |

(52) U.S. Cl.

CPC ..... *A47L 11/4044* (2013.01); *A47L 5/28* (2013.01); *A47L 5/30* (2013.01); *A47L 9/02* (2013.01); *A47L 9/0444* (2013.01); *A47L 9/0477* (2013.01); *A47L 11/4069* (2013.01)

(58) Field of Classification Search

CPC ..... A47L 9/0477; A47L 9/02; A47L 9/0444; A47L 5/30; A47L 11/19; A47L 11/18; A47L 11/4044

USPC ..... 15/411, 412

See application file for complete search history.

(56) References Cited

U.S. PATENT DOCUMENTS

| | | | | |
|---|---|---|---|---|
| 1,104,612 A * | 7/1914 | Bodey | A47L 9/0422 15/351 |
| 1,139,736 A * | 5/1915 | Stabel | 15/411 |
| 1,829,582 A * | 10/1931 | Carson | 15/347 |

(Continued)

FOREIGN PATENT DOCUMENTS

| | | | | |
|---|---|---|---|---|
| FR | 364280 | * | 8/1906 | A47L 11/18 |
| FR | 2558711 | | 8/1985 | |

(Continued)

OTHER PUBLICATIONS

International Search Report and Written Opinion for Application No. PCT/US2014/011696 dated Apr. 2, 2014 (11 pages).

(Continued)

*Primary Examiner* — Joseph J Hail
*Assistant Examiner* — Arman Milanian
(74) *Attorney, Agent, or Firm* — Michael Best & Friedrich LLP

(57) ABSTRACT

The principles and embodiments of the presently claimed invention relate to steerable, light-weight, low-profile suction bases for upright cleaning apparatuses that utilize a smaller suction base body to reduce weight and bulk, while still providing sufficient room for an internally mounted brush roll motor and controller PCB, plus additional mechanical and electrical components in the suction base.

11 Claims, 15 Drawing Sheets

(56) References Cited

U.S. PATENT DOCUMENTS

| | | | | |
|---|---|---|---|---|
| 4,050,112 | A * | 9/1977 | Saxon | A47L 5/30 15/351 |
| 4,637,092 | A * | 1/1987 | Hayashi | A47L 5/30 15/319 |
| 5,354,347 | A * | 10/1994 | McCoy et al. | 96/330 |
| 5,794,305 | A * | 8/1998 | Weger | 15/411 |
| 6,055,703 | A * | 5/2000 | Redding et al. | 15/411 |
| 6,282,748 | B1 * | 9/2001 | Thur et al. | 15/383 |
| 6,629,332 | B2 * | 10/2003 | Morgan et al. | 15/320 |
| D498,887 | S * | 11/2004 | Kent | D32/22 |
| 6,968,587 | B2 * | 11/2005 | Grey | A46B 13/001 15/377 |
| 7,181,804 | B2 * | 2/2007 | Hafling | A47L 9/122 15/347 |
| 7,257,859 | B2 * | 8/2007 | Nam et al. | 15/375 |
| 7,805,804 | B2 * | 10/2010 | Loebig | 15/351 |
| 8,176,596 | B2 * | 5/2012 | Conrad | A47L 9/125 15/347 |
| D683,089 | S * | 5/2013 | Paterson | D32/22 |
| 8,661,613 | B2 * | 3/2014 | Marsh et al. | 15/411 |
| 8,914,940 | B2 * | 12/2014 | Morgan | A47L 5/30 15/351 |
| 9,074,622 | B2 * | 7/2015 | Morgan | A47L 5/30 |
| 9,301,662 | B2 | 4/2016 | Conrad | |
| 2004/0211023 | A1 | 10/2004 | Streciwilk | |
| 2008/0216281 | A1 | 9/2008 | Conrad | |
| 2008/0216283 | A1 * | 9/2008 | Miner | A47L 5/225 15/390 |
| 2009/0126145 | A1 * | 5/2009 | D'Agostino | A47L 5/28 15/339 |
| 2011/0107553 | A1 | 5/2011 | Myers | |
| 2011/0303239 | A1 * | 12/2011 | Harrison | A47L 5/30 134/6 |
| 2012/0090105 | A1 | 4/2012 | Henderson | |

FOREIGN PATENT DOCUMENTS

| | | | | |
|---|---|---|---|---|
| JP | FR 2558711 | A1 * | 8/1985 | A47L 5/30 |
| JP | 2010253206 | | 11/2010 | |

OTHER PUBLICATIONS

European Patent Office Action for Application No. 14702705.6 dated Aug. 3, 2016 (9 pages).

English Translation of Chinese Patent Office Action for Application No. 201480005097.3 dated Apr. 1, 2016 (13 pages).

* cited by examiner

VACUUM SUCTION BASE DEVICE WITH SWIVEL COUPLING HAVING ELECTRIC MOTOR INSIDE A WHEEL AND GAPS FOR VISIBILITY

BACKGROUND OF THE INVENTION

Field of the Invention

The principles and embodiments of the presently claimed invention relate to steerable, light-weight, low-profile suction bases for upright cleaning apparatuses.

Upright cleaning apparatuses using air suction have been known in the art, and various modifications have been made over time to the size, shape, method of suction, and attachments for such devices. However, the size, shape, and weight of the base portion of such upright cleaning apparatuses have been a notable limitation on their overall utility. The suction base units have tended to be large, bulky components of upright vacuums that were difficult to fit under and maneuver around furniture. The design of previous suction bases have sometimes required large electrical motors to provide suction and drive a rotating brush roll, that places much weight in the suction base itself. Such design issues have limited the forms of the vacuum cleaner base and bodies, and added to the overall complexity of designs. The embodiments of the presently claimed invention overcome these problems and limitations by eliminating the restrictive placement of the internal components, while incorporating a swivel joint between the suction base and upright main body of the cleaning apparatus.

BRIEF SUMMARY OF THE INVENTION

The principles and embodiments of the presently claimed invention relate to reducing the size and weight of an upright cleaning apparatus suction base, while improving the overall maneuverability of the cleaning apparatus by locating a smaller, lighter electrical motor in an advantageous location that allows the use of a straight air path and swivel joint in the base.

The principles and embodiments also relate to eliminating the full-size suction base body and providing a reduced width and profile design, while broadening how various electrical and structural features are implemented within the cleaning device suction base.

An embodiment of the invention may comprise a light-weight suction base unit for an upright cleaning apparatus that comprises a suction base body, a left base support operatively associated with the suction base body, such that there is a gap between a portion of the left base support and a portion of the suction base body, a right base support operatively associated with the suction base body, such that there is a gap between a portion of the left base support and a portion of the suction base body; a brush roll cavity body operatively associated with the suction base body to form a brush roll cavity having a brush roll cavity intake and a brush roll cavity discharge opening, a rotary hose bracket, a straight suction conduit having a hose inlet operatively associated and in fluid communication with the brush roll cavity, and a hose outlet operatively associated and in fluid communication with the rotary hose bracket, a rotary swivel coupling operatively associated with the rotary hose bracket, and a main body junction conduit providing a fluid communication to an upright main housing.

An embodiment of the invention may further comprise a swivel joint housing operatively associated with the rotary hose bracket and rotary swivel coupling that provides a rotatable junction between the suction base unit and an upright main housing operatively associated with the rotary swivel coupling to cause the suction base unit to turn left or right in reaction to the upright main housing being tilted in the same direction.

An embodiment of the invention may further comprise an electric motor mounted within the suction base body such that a portion of the electric motor sits within an annular opening in a rear wheel, a brush roll mounted within the brush roll cavity, a brush roll gear operatively associated with the brush roll, a drive gear affixed to a rotating shaft of the electric motor, a drive belt that runs from the drive gear attached to the electric motor to the brush roll gear to cause the brush roll to rotate, wherein the drive belt resides outside of the suction base body and at least a portion of the drive belt is covered by the right base support.

An embodiment of the invention may further comprise a rear body cover attached to a lower suction base housing of the suction base body, and covers the electric motor, wherein the rear body cover has one or more openings to vent warm air from the inside of the suction base body.

An embodiment of the invention may further comprise a controller PCB mounted within the suction base body that is electrically connected and transmits power to the electric motor; and a micro-switch 109 mounted within the suction base body that is electrically connected to the PCB over an electrical path, wherein the micro-switch 109 has an actuator positioned to engage a corresponding face of the swivel joint housing, such that the face of the swivel joint housing triggers the micro-switch actuator to signal the PCB over the electrical path to interrupt the transmission of power to the electric motor, when the swivel joint is in the fully upright position.

An embodiment of the invention may further comprise annular openings in the rotary swivel coupling and the rotary hose bracket, wherein the openings are aligned to allow wiring from the PCB to run alongside the air path.

Another embodiment of the invention may comprise a low-profile suction base unit having a reduced profile swivel joint comprising a suction base body, a left base support operatively associated with the suction base body, such that there is a viewing opening between a portion of the left base support and a portion of the suction base body, a right base support operatively associated with the suction base body, such that there is a viewing opening between a portion of the left base support and a portion of the suction base body, and a swivel joint housing and a rotary swivel coupling operatively associated with an upright main housing and the suction base unit, wherein the swivel joint causes the suction base unit to pivot left when the upright main housing is tilted left and the suction base unit to pivot right when the upright main housing is tilted right, while allowing a user to view a surface being cleaned through viewing openings.

An embodiment of the invention may further comprise two rear wheels operatively associated with the suction base body, wherein the height of the wheels is preferably no greater than 5½ inches.

An embodiment of the invention may further comprise a low-profile suction base unit, wherein the height of the suction base unit at the top edge of the rotary swivel coupling is preferably no greater than 5¾ inches.

BRIEF DESCRIPTION OF THE DRAWINGS

Further features of the present invention, its nature and various advantages will become more apparent upon consideration of the following detailed description, taken in conjunction with the accompanying drawings, which are also illustrative of the best mode contemplated by the applicants, and in which like reference characters refer to like parts throughout, where.

DETAILED DESCRIPTION OF THE INVENTION

The principles of the present invention relate to redesigning of a vacuum suction base to reduce its weight and bulk, while improving its suction performance and maneuverability, In embodiments of the present invention, an electric motor for driving a beater brush is located in an internal portion of a suction base body that is in axial alignment with the axis of rotation of the supporting wheels.

In embodiments of the present invention, an air gap and exhaust openings are incorporated into the upper section of the suction base body of a cleaning apparatus to provide for the escape of hot air generated by the electric brush roll motor.

The principles of the present invention relate to providing a straight air path from the suction nozzle openings to the swivel joint conduit, and an articulate connection between the swivel joint conduit and the main body junction conduit to reduce the resistance to suction air flow.

The principles of the present invention relate to utilizing a smaller suction base body to reduce weight and bulk, and still provide sufficient room for mechanical and electrical components in the suction base.

The various parts can be joined or affixed to each other using snaps, mechanical fasteners, adhesives, and push or press fit connections, as would be know to those of ordinary skill in the art.

Examples of different embodiments of each of the various components as well as different embodiments of the overall apparatus will now be described in more detail with reference to the figures. It should be understood that these drawings only illustrate some of the preferred embodiments, and do not represent the full scope of the present invention for which reference should be made to the accompanying claims.

A non-limiting example of a preferred embodiment will now be described in reference to the apparatus depicted in the following figures.

Figure 1:
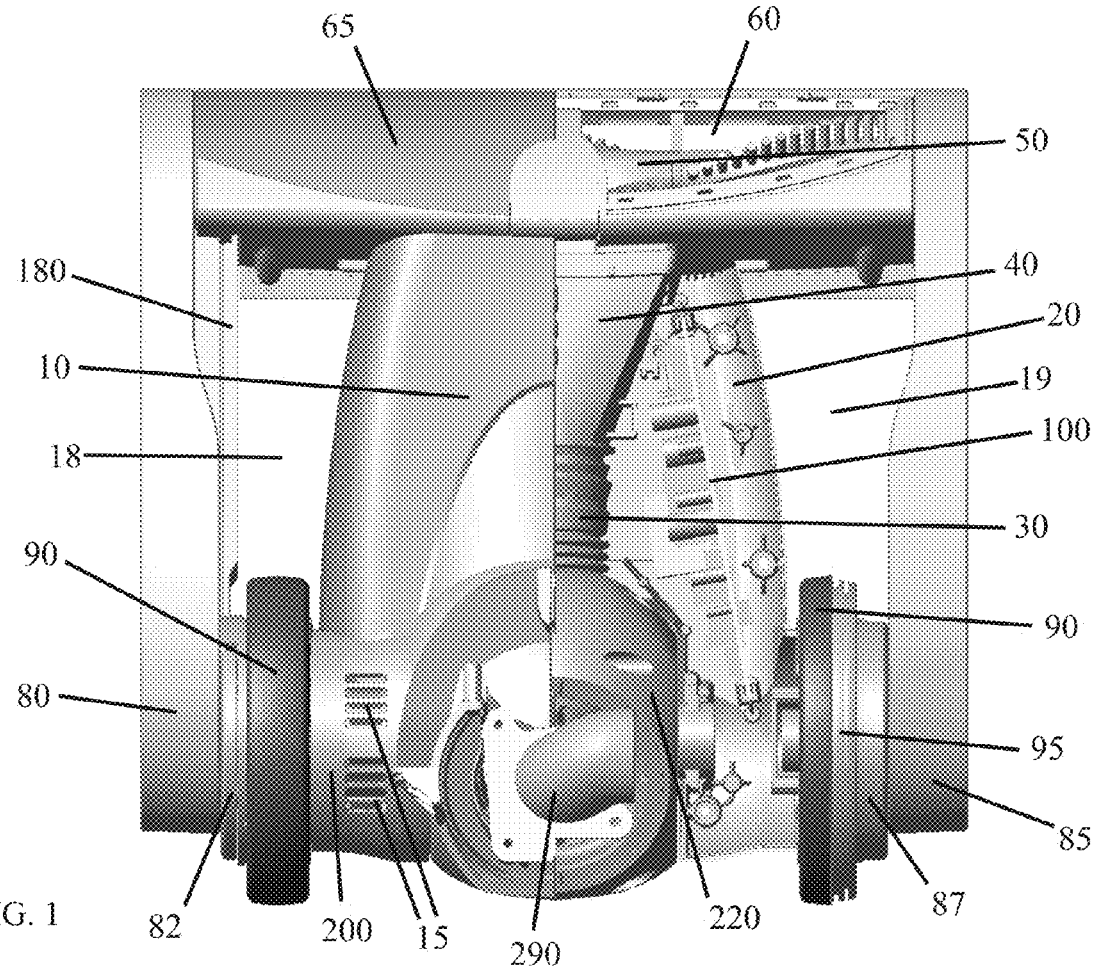
FIG. 1 illustrates a top view of an embodiment of a cleaning apparatus suction base with a cut-away view of the right-hand side.

FIG. 1 illustrates atop view of an embodiment of a cleaning apparatus suction base with a cut-away view of the right-hand side. The suction base body of the suction base unit comprises an upper suction base housing 10 with an interior and exterior surface, and a lower suction base housing 20 with an interior and exterior surface, where the upper suction base housing 10 and lower suction base housing 20 form an interior volume configured and dimensioned to encase and support various structural, mechanical, and electrical components when joined together. The upper suction base housing 10 is joined to the lower suction base housing 20 using mechanical fasteners, snaps, and adhesives, as known in the art.

Figure 1A:
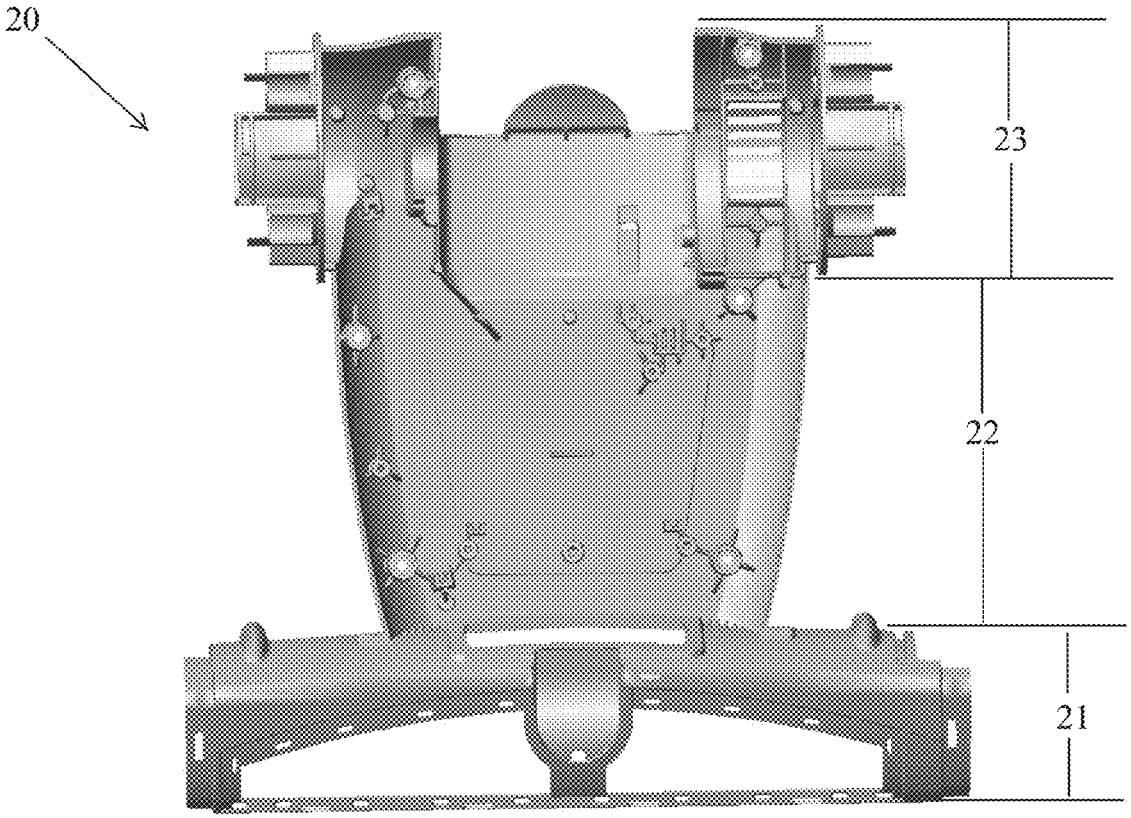
FIG. 1A illustrates an embodiment of a lower suction base housing indicating front, center, and rear sections.

The lower suction base housing 20 comprises three sections, as shown in FIG. 1A, a front section 21 that forms a portion of the brush roll cavity, a center section 22 that houses at least a printed circuit board 100 and suction conduit 30, 40, and a rear section 23 that supports the rear wheels, an electric motor 150 that drives the brush roll, and a swivel joint that connects with and communicates debris-laden air to an upright main housing (not shown). The center section 22 is narrower than the front section 21 or rear section 22 to save weight and reduce the size of the suction base unit. The lower suction base housing may have one or more structural features for supporting other mechanical and electrical components.

The swivel joint allows a user to turn the suction base by pivoting an upright main body to the left or right, which applies a force to the left and right swivel housings.

Figure 6:
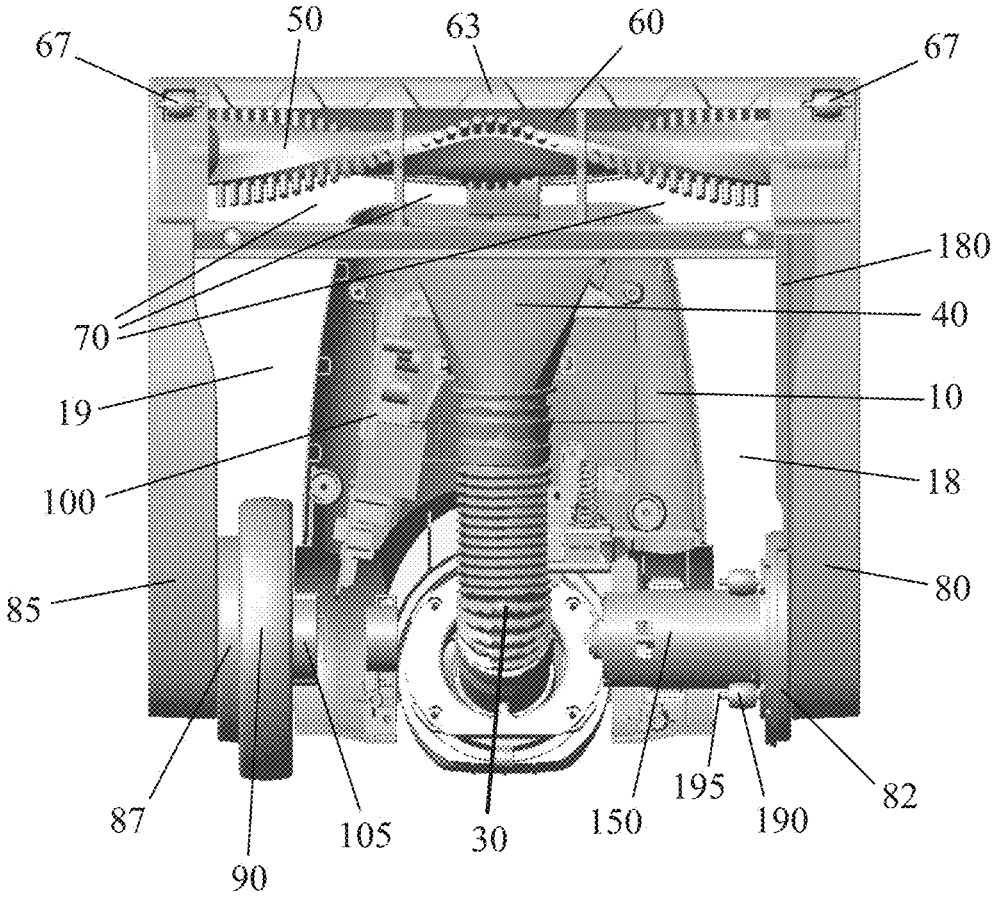
FIG. 6 illustrates a cut-away view from the bottom of an embodiment of the suction base unit.

A brush roll cavity 60 and brush roll cavity intake 70 are formed by a brush roll cavity body 65, the lower suction base housing 20, and a brush roll cavity guard 63 (see FIG. 6). The brush roll 50 is supported inside the brush roll cavity by bushings or support blocks 57, 58 (see FIG. 14) mounted in recesses in the side walls of the lower suction base housing 20, and/or brush roll cavity guard 63. The recesses are configured and dimensioned to retain the bushings or pillow blocks.

The front section 21 of the lower suction base body extends laterally away from the center section 22 to form a brush roll cavity 60 having a greater width than the center section 22 of the lower suction base housing 20 and upper suction base housing 10. The upper suction base housing covers and encloses the center section 22 of the suction base.

A tapered suction channel 40 is operatively associated and in fluid communication with a discharge opening 75 in a rear portion of the brush roll cavity 60 to apply a negative pressure from a suction source (not shown) located in the upright main body (not shown) to the brush roll cavity intake 70 to pick up debris. An inlet end of a suction hose is operatively associated and in fluid communication with the tapered suction channel outlet 47. A suction hose outlet is operatively associated and in fluid communication with a rotary hose bracket 210. The arrangement of the tapered channel 40 and suction hose 30 forms a suction conduit that provides a straight air path that is shorter, takes up less space, and reduces resistance to air flow compared to curved air flow paths.

Rear wheel bodies 95 are operatively associated with the lower suction base housing, and freely rotate around an axis of rotation. An overmold 90 covers each of the rear wheel bodies 95 to provide a smooth rubber surface to ride upon a surface.

A rear body cover 200 mounts to the lower suction base housing 20 to cover the swivel joint components, the electric motor 150, the wheel posts 195 and bearings 190, wiring, and other components inside the rear section 23 of the suction base. The rear body cover 200 has openings 15 that allows air-flow within the suction base, and heat built up from the electric motor to escape the suction base. The rear body cover 200 has a sloping shape that slants upwards from the edge closest to the wheel to the edge closest to the swivel joint. The sloping shape and an air gap between the motor and cover 200 assists in directing rising hot air from the motor to the openings 15, which improves the life of the motor.

The suction base body has a left wheel lock 87 attached to the suction base body; and a left base support 85 attached to the left wheel lock, such that there is a gap between a portion of the left base support and a portion of the suction base body. Similarly, the suction base has a right wheel lock 82 attached to the suction base body; and a right base support 80; attached to the left wheel lock, such that there is a gap between a portion of the left base support and a portion of the suction base body. The gap between the left base support 85 and the suction base body is a left viewing opening 19 that allows a user to see the floor between the support and body. The gap between the right base support 80 and the suction base body is a right viewing opening 18 that allows a user to see the floor between the support and body.

The right and left base supports 80, 85 provide a supporting surface that can ride across the horizontal surface being cleaned to provide additional stability against sideways tipping to the suction base. The right base support 80 and a drive belt cover 180 also covers a drive belt 160 that runs from the drive gear 170 attached to an electric motor 150 to a brush roll 59 gear to cause the brush roll 50 to rotate.

Figure 2:
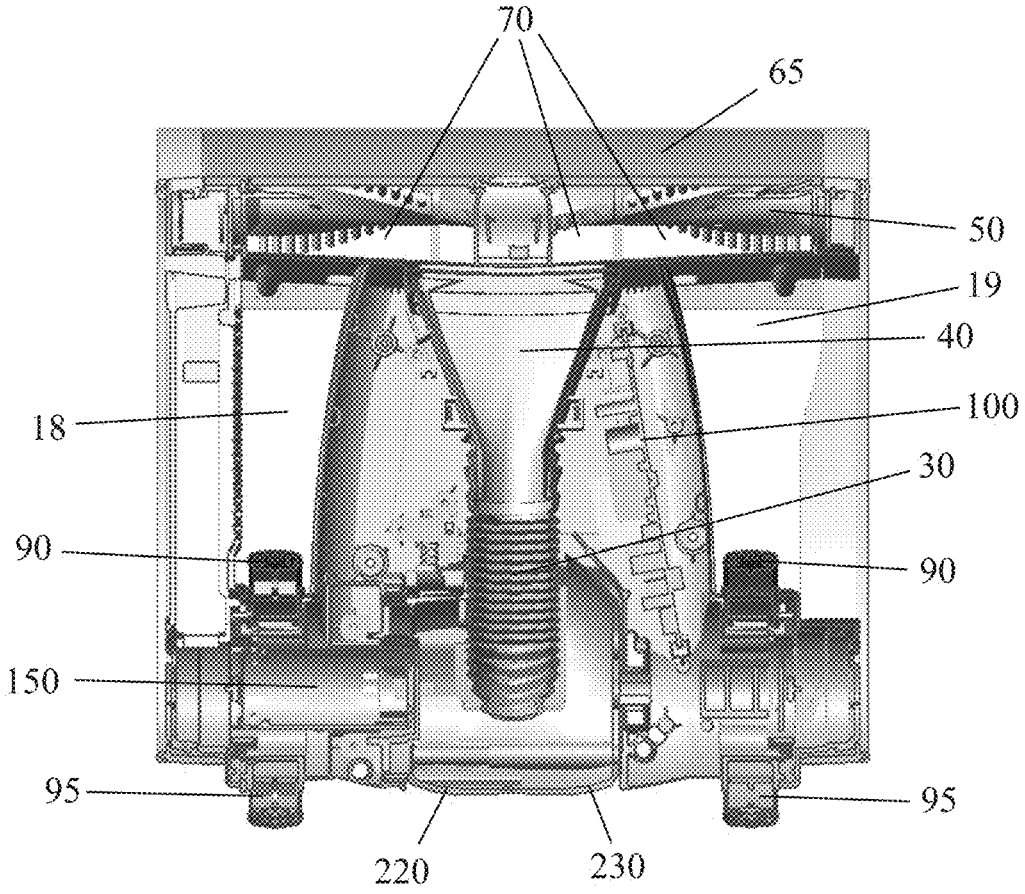
FIG. 2 is a cut-away view of an embodiment of the suction base looking down from the top.

FIG. 2 is a cut-away view of an embodiment of the suction base looking down from the top. A brush roll 50 rides above a brush roll cavity intake 70 that is formed by a brush roll cavity body 65, the lower suction base housing 20, and a brush roll cavity guard 67. The brush roll 50 is supported inside the brush roll cavity by left and right support blocks 57, 58 mounted in recesses in the side walls of the lower suction base housing 20, and/or brush roll cavity guard 67. The recesses are configured and dimensioned to retain the bushings or pillow blocks, which may be shaped protrusions extending outwardly from a face of the support blocks. Suction is supplied from a suction source located in the cleaning apparatus main body (not shown) to the brush roll cavity 60 and brush roll cavity intake 70 through a suction hose 30 and tapered suction channel 40, which has a channel inlet 43 connected to the brush roll cavity discharge opening 75. The suction hose 30, tapered suction channel 40, and brush roll cavity 60 are all in fluid communication with the suction source, which produces a negative pressure to lift debris from a surface being cleaned.

An electric motor 150 sits within a molded cradle formed in the lower suction base housing 20 partially within the rear wheel body 95 and rear wheel overmold 90, and is covered by the rear body cover 200. Openings 15 in the rear body cover allow warm air generated by the electric motor 150 to escape from the interior volume of the suction body. Other electronic components may be positioned partially within the wheel body 95 on the left side of the suction base.

A controller PCB is mounted in support columns molded into the lower suction base housing 20, and sits adjacent to the tapered suction channel 40 and suction hose 30. The straight arrangement of the tapered suction channel 40 and suction hose 30 provides sufficient room on either side for the PCB to be mounted in the suction base body.

The viewing gaps 18, 19 allow a user to see the surface being cleaned both in front of and to each side of the suction body behind the brush roll cavity, so a user is more likely to see if they are about to suction up a valuable or undesirable piece of debris.

Figure 3:
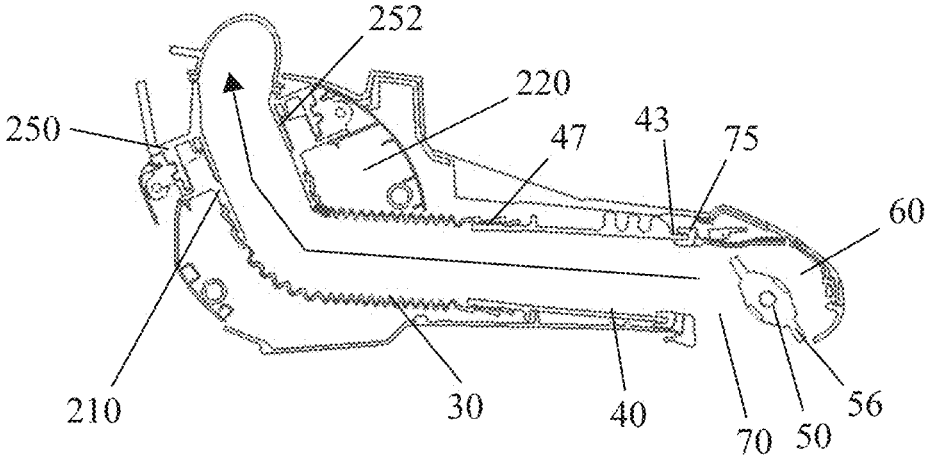
FIG. 3 illustrates a cut-away view of an embodiment of the brush roll cavity and air path.

FIG. 3 illustrated a cut-away view of an embodiment of the brush roll cavity 60 and air path (depicted by the arrow) from the brush roll cavity intake 70, through the tapered suction channel 40 and suction hose 30 to the suction hose bracket 210 and rotary swivel coupling 250. The rotary swivel coupling 250 maintains a seal with the suction hose bracket 210, with an annular portion 252 that sits within the hose coupling 210, while allowing the swivel coupling 250 to rotate around the central axis and the air path. Rotation of the swivel coupling 250 also applies a force to the right and left swivel housings 220, 230, which causes the suction base to turn right or left. This swivel joint thereby improves the maneuverability of the suction base white maintaining an essentially straight air path from the from the brush roll cavity intake 70 to the rotary swivel coupling 250 with only a single upward bend at the junction of the suction hose 30 and suction hose coupling 210.

The brush roll 50 sits within the brush roll cavity 60, and is mounted at either end to recesses in the side walls of the lower suction base housing 20, and/or brush roll cavity guard 67 with support blocks 57, 58. The bristles 56 of the brush roll may extend past the brush roll cavity intake 70 to sweep debris into the cavity 60.

Figure 4:
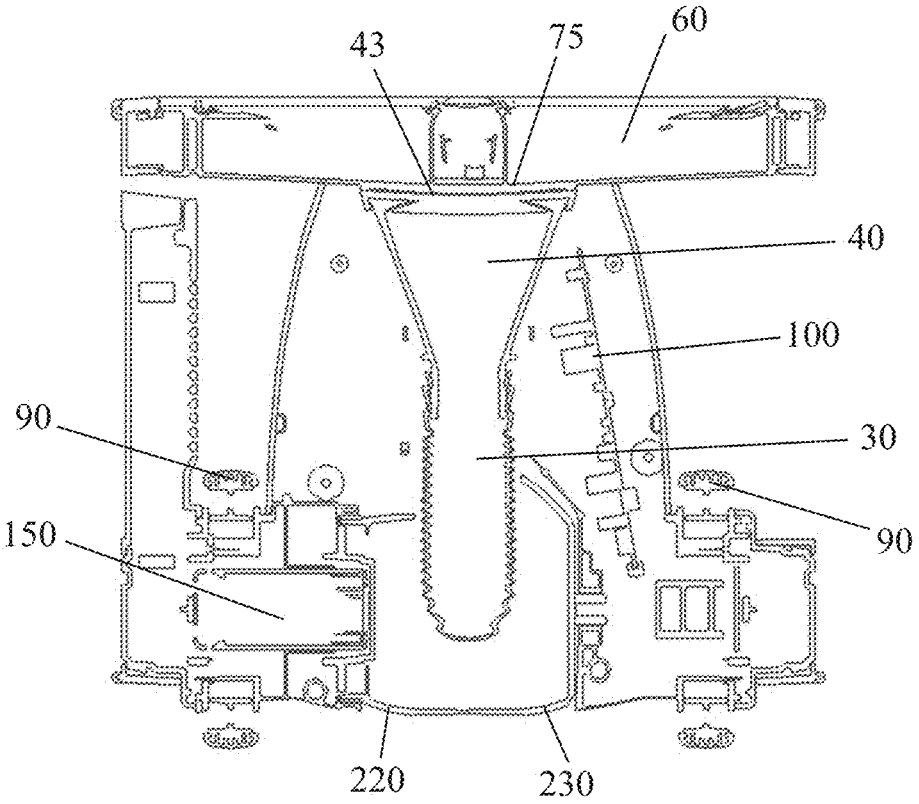
FIG. 4 illustrates a cut-away view of an embodiment of the suction base looking down from the top.

FIG. 4 illustrates a cut-away view of an embodiment of the suction base looking down from the top. FIG. 4 shows the suction channel inlet 43 coupled to the brush roll cavity 60 at the brush roll discharge opening 75.

The electric motor 150 for driving the brush roll is shown within the wheel 90 and the right swivel housing 220.

Figure 5:
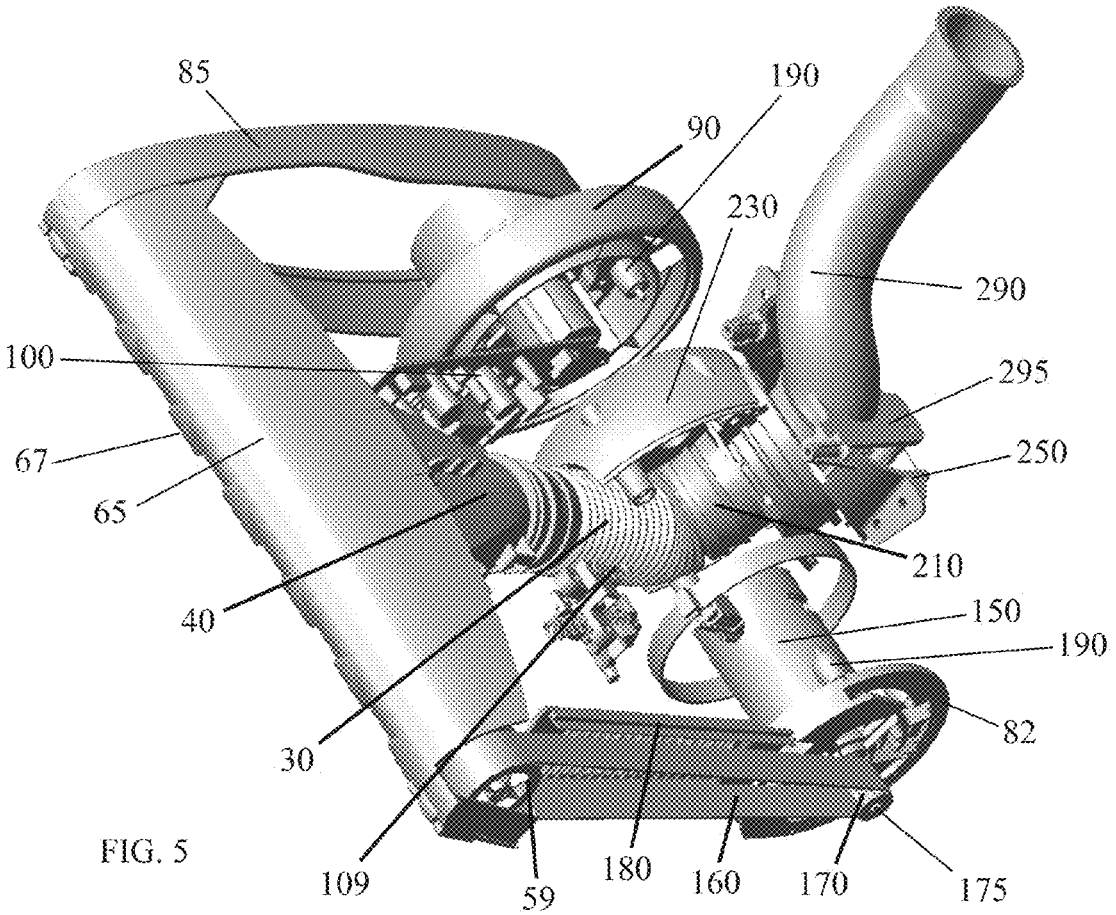
FIG. 5 illustrates an orthographic view of a partially cut-away view of an embodiment of the suction base.

FIG. 5 illustrates an orthographic view of a partially cut-away view of an embodiment of the suction base. The front of the suction base unit shows the brush roll cavity body 65 and brush roll cavity guard 67 coming together to form a front face of the brush roll cavity 60.

A main body junction conduit 290 is operatively associated with the swivel coupling 250 and held in place with a junction conduit bezel 295. The left side swivel housing 230 is operatively associated with the swivel coupling 250 and joined to the right swivel housing (not shown) to control the turning of the suction base unit while maintaining the alignment of the suction conduit.

A brush roll gear 59 is shown attached to and operatively associated with the brush roll 50. A drive gear 170 is affixed to and operatively associated with a rotating shaft 175 of the electric motor 150 to drive the drive belt 160 that rotates the brush roll gear 59 and thereby the brush roll 50. The drive belt 160 is preferably outside of the suction base body and covered by the right side base support (not shown) and drive belt cover 180. The vented drive belt cover 180 can prevent contact with the drive belt from the side facing the viewing opening while providing air circulation to the belt and gears.

A drive belt 160 that runs from the drive gear 170 attached to the electric motor 150 to the brush roll gear 59 to cause the brush roll to rotate, wherein the drive belt 160 resides outside of the suction base body and at least a portion of the drive belt is covered by the right base support 80.

FIG. 6 illustrates a cut-away view from the bottom of an embodiment of the suction base unit. Front wheels 67 may be located on opposite sides of the brush roll cavity 60, and/or at the ends of the right and left base supports 80, 85. A brush roll cavity guard 63 may cover the bottom of the brush roll cavity 60 leaving one or more openings for the brush roll cavity intake 70. The brush roll 50 is shown mounted within the brush roll cavity with sufficient clearance to freely rotate when driven by the electric motor 150. Vacuum debris is pulled through a suction conduit including the tapered suction channel 40 and suction hose 30 that are in an essentially straight line to the hose coupling 210, where the air path curves upwards to the main body junction conduit and the upright main housing of an upright cleaning apparatus. The suction source is located in the main housing (not shown) along with a bagless debris collecting device (not shown) and is in fluid communication with the coupling, suction conduit, and cavity.

The wheels ride on a plurality of wheel bearings 190 mounted on bearing posts 195 positioned a distance from the axis of rotation to allow the wheel to freely rotate while providing an open space around the center of the wheel body 95 for positioning the electric motor 150 and other electronics 105.

Additional electronic components 105 may be located in the central opening of the rear wheel on the side opposite the electric motor 150.

The upper suction base housing 10 covers the components located in the center section of the suction base body.

Figure 7:
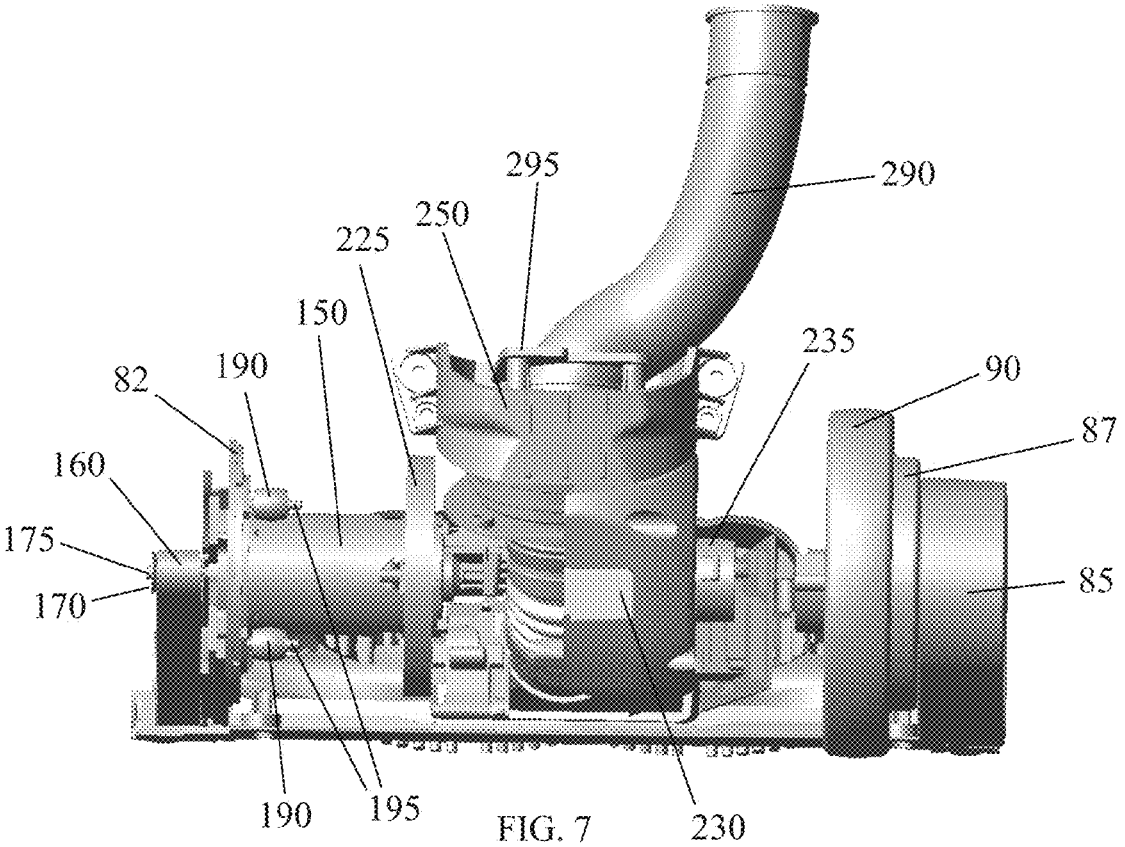
FIG. 7 illustrates a cut-away rear view of an embodiment of the suction base unit showing positioning of the motor and a drive belt mounted on the drive gear affixed to the motor shaft.

FIG. 7 illustrates a cut-away rear view of an embodiment of the suction base unit showing positioning of the motor 150 between the swivel joint and the wheel. The motor 150 can fit within an radial opening in the center of the wheel body because the wheel sits on a plurality of wheel bearings 190 mounted on bearing posts 195, and held in place by a right wheel lock 82 attached to the suction base body.

A swivel joint housing comprising a right swivel joint housing (not shown) and a left swivel joint housing 230 is supported by bushings 225, 235 mounted in supports formed in the lower suction base housing 20. The rotary swivel coupling 250 sits on top of the swivel joint housing and applies a force to the top surface of the swivel joint housing when the swivel coupling 250 is rotated by tilting an upright main housing (not shown) attached thereto. A main body junction conduit 290 is secured to the rotary swivel coupling 250 with a junction conduit bezel 295 and mechanical fasteners known in the art.

FIG. 7 also illustrates the drive belt 160 mounted on the drive gear 170, which is affixed to the motor shaft 175.

Figure 8:
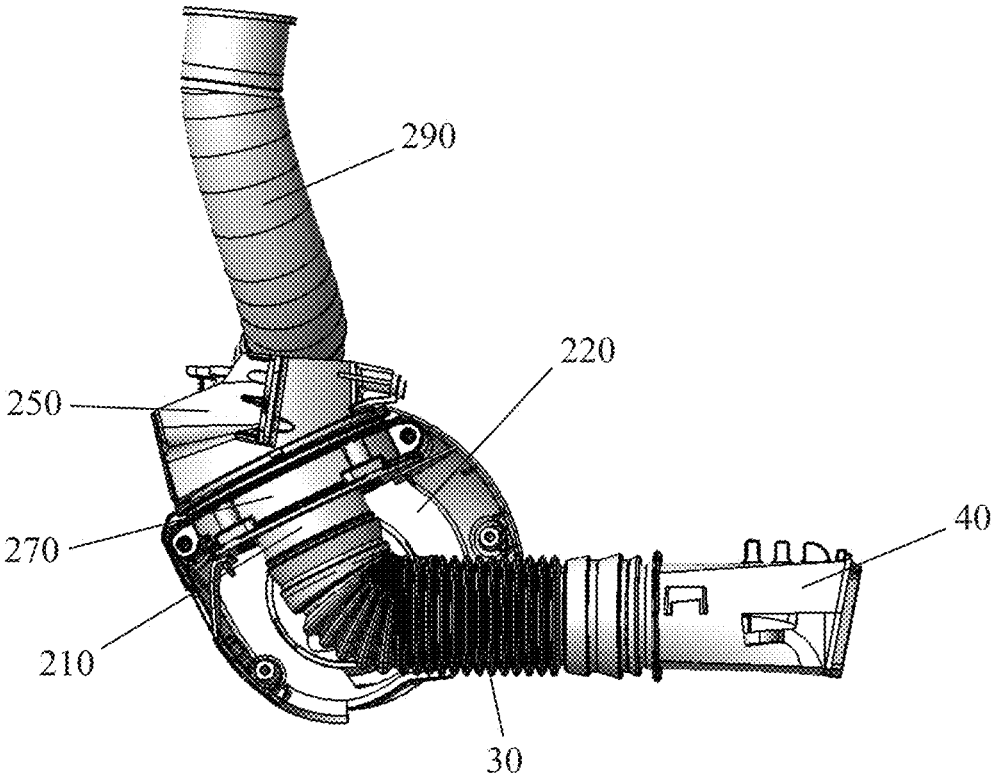
FIG. 8 illustrates a cut-away side view of an embodiment of the swivel joint showing the right side of the swivel housing.

FIG. 8 illustrates a cutaway side view of an embodiment of the swivel joint showing the right swivel housing 220. The rotary swivel coupling 250 sits on top of the swivel joint housing and coupled with the rotary hose bracket 210, and the left rotation joint bezel 270 and a right rotation joint bezel 280 (not shown) secures the rotary swivel coupling 250 to the swivel joint housing. The main body junction conduit 290 is secured to the rotary swivel coupling 250 with a junction conduit bezel (not shown). A suction conduit comprising the suction hose 30 and suction channel 40 is connected to and in fluid communication with the rotary hose bracket 210.

The joint housing allows an upright main body to pivot forwards and backwards in a vertical plane, while the rotary coupling allows the upright main housing to rotate left and right out of the plane. The combined action of pivoting and rotation steers the suction base to the left or right depending upon the direction of rotation, while the suction conduit remains in an essentially straight line within the suction base body. Wiring can be run coaxially from the suction base body to the upright main housing through openings in the rotary hose bracket 210 and rotary swivel coupling 250 without kinking or pulling due to the component alignment and freedom of pivoting and rotational motion.

Figure 9:
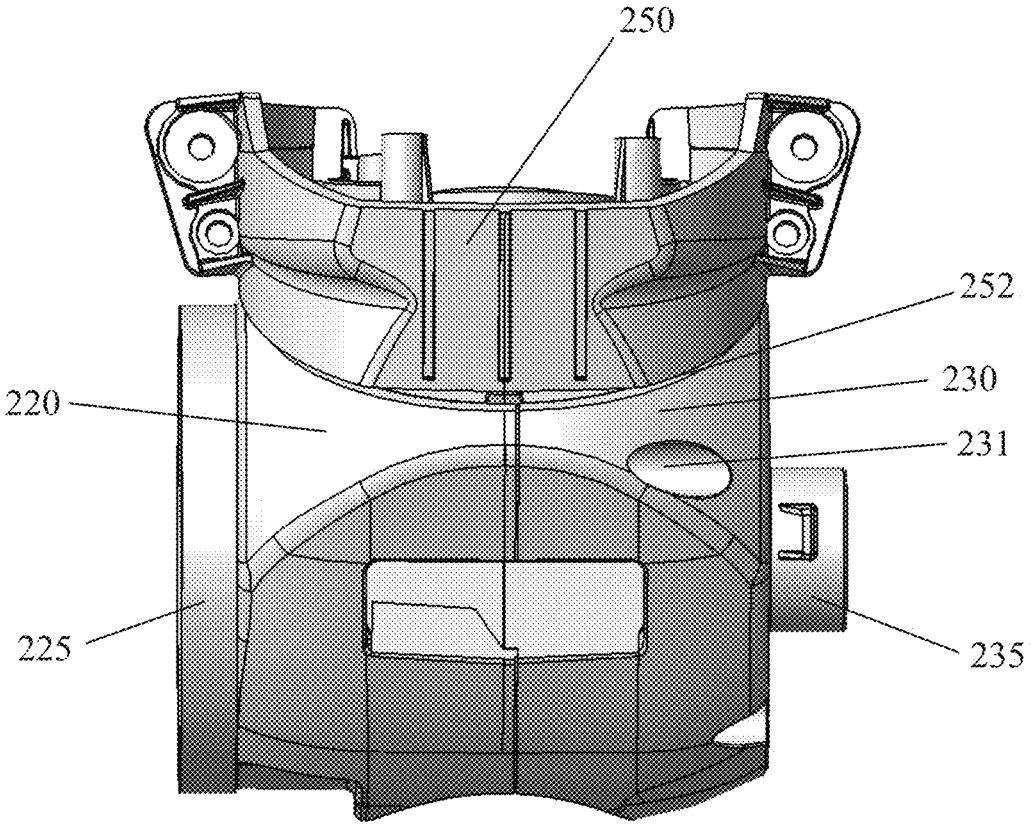
FIG. 9 illustrates an embodiment of the swivel joint showing right and left swivel housings.

FIG. 9 illustrates an embodiment of the swivel joint showing the right and left swivel housings 220, 230, secured together with one or more mechanical fasteners located in recesses such as fastener opening 231, to form the swivel joint housing and rotary swivel coupling 250 coupled to the swivel joint housing and forming the mating interface 252. The swivel joint is supported in the tower suction base housing 20 by right bushing 225 and left bushing 235.

Figure 10:
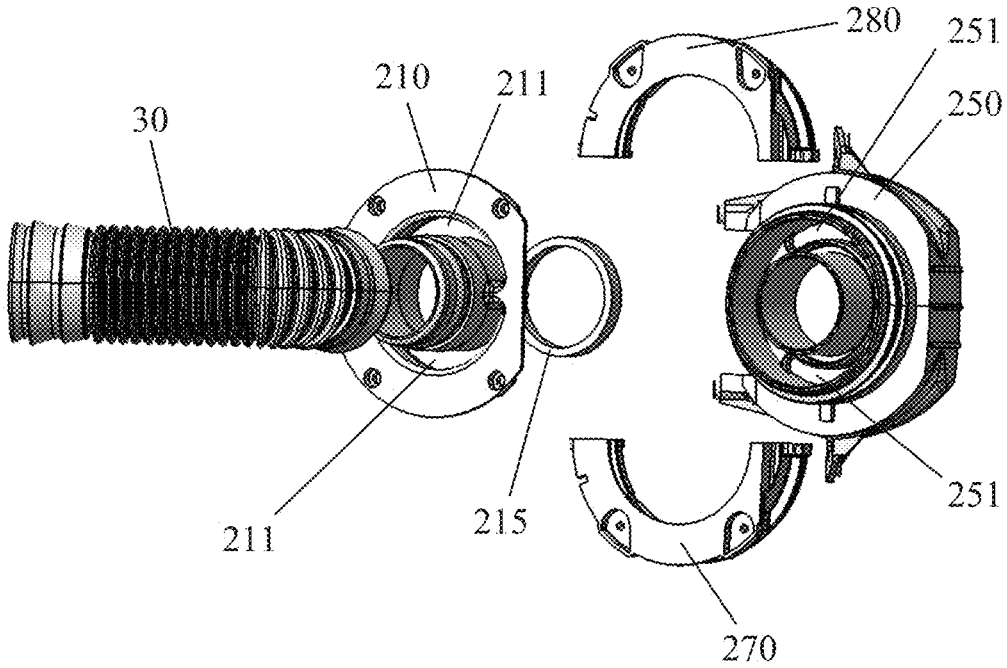
FIG. 10 illustrates an exploded view of an embodiment of a rotary coupling.

FIG. 10 illustrates an exploded view of an embodiment of the rotary coupling formed by the interfacing of the rotary swivel coupling 250 with the rotary hose bracket 210. A gasket 215, which may be felt or hair fits within a groove in the rotary swivel coupling 250, and the annular tube of the rotary hose bracket 210 presses against the gasket 215 to form a first seal while the annular tube of the rotary swivel coupling 250 slips into the inner diameter of the rotary hose bracket 210 to form a second seal to contain the debris and vacuum. Openings 211 in the rotary hose bracket 210 and openings 251 in the rotary swivel coupling 250 allow wires to pass co-linearly along side the suction conduit and coupling without kinking or pulling when the coupling rotates. The left rotation joint bezel 270 and right rotation joint bezel 280 can be connected around an annular ring on the bottom face of the rotary swivel coupling 250 to couple it to the swivel joint housing to prevent axial movement of the swivel coupling relative to the swivel joint and hose bracket 210 while allowing rotational movement.

Figure 11:
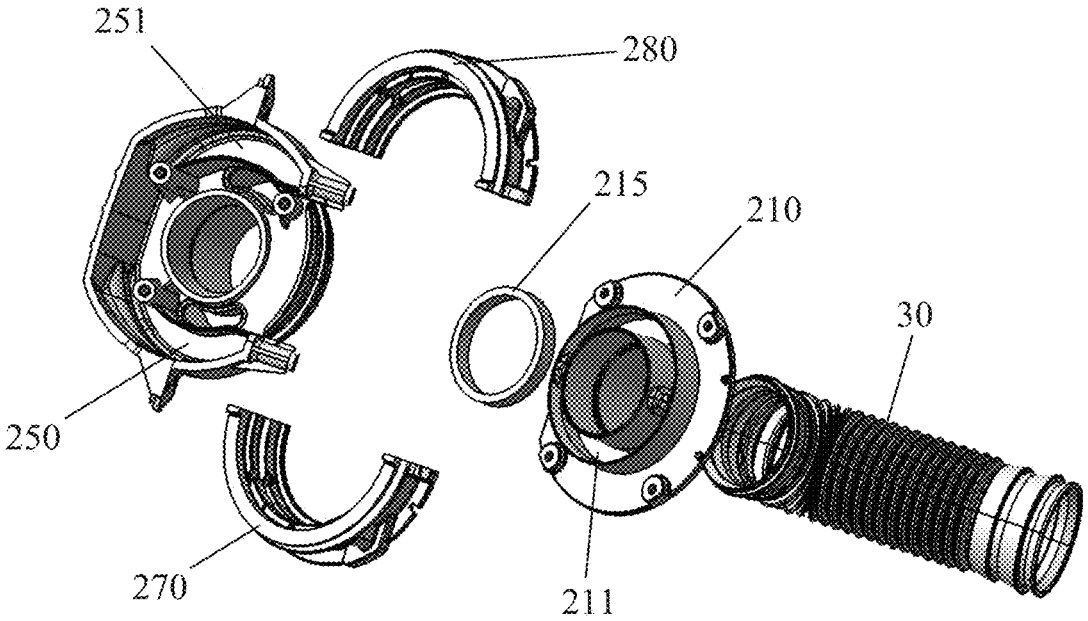
FIG. 11 illustrates an exploded view of an embodiment of the rotary coupling.

FIG. 11 illustrates an exploded view of an embodiment of the rotary coupling from another angle showing the openings 211 in the rotary hose bracket 210 and openings 251 in the rotary swivel coupling 250.

Figure 12:
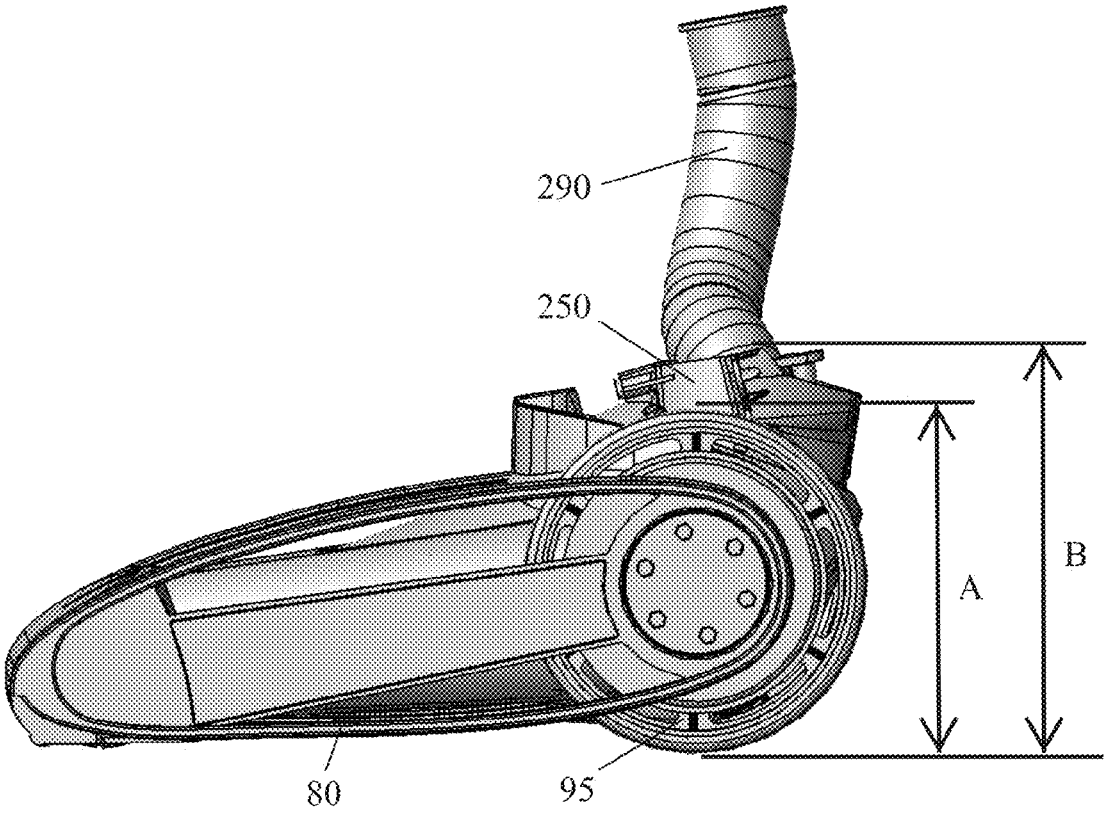
FIG. 12 illustrates a side view of an embodiment of a suction base unit having rear wheels.

FIG. 12 illustrates aside view of an embodiment of a suction base unit having rear wheels primarily supporting the weight of the suction base and an upright main body (not shown), where the height of the suction base at the wheels A is preferably no greater than 5½ inches, and more preferably no greater than 5 inches, and most preferably less than 4¾ inches. Similarly, the height of the suction base at the top edge of the rotary swivel coupling 250 is preferably no greater than 5¾ inches, and more preferably no greater than 5½ inches, and most preferably less than 5⅜ inches. Reducing the height of the suction base at the wheels and the top of the swivel housing provides the benefits of reduced material and weight while allowing the suction base to fit under lower obstructions and into smaller vertical gaps, such as the gap between a floor and a front rail of a couch or a bed frame.

The height of the brush roll housing is preferably less than 2⅝ inches, more preferable not greater than 2½ inches, and most preferably not greater than 2⅜ inches, to allow the brush roll cavity to fit under tower obstructions and into smaller vertical gaps.

Figure 13:
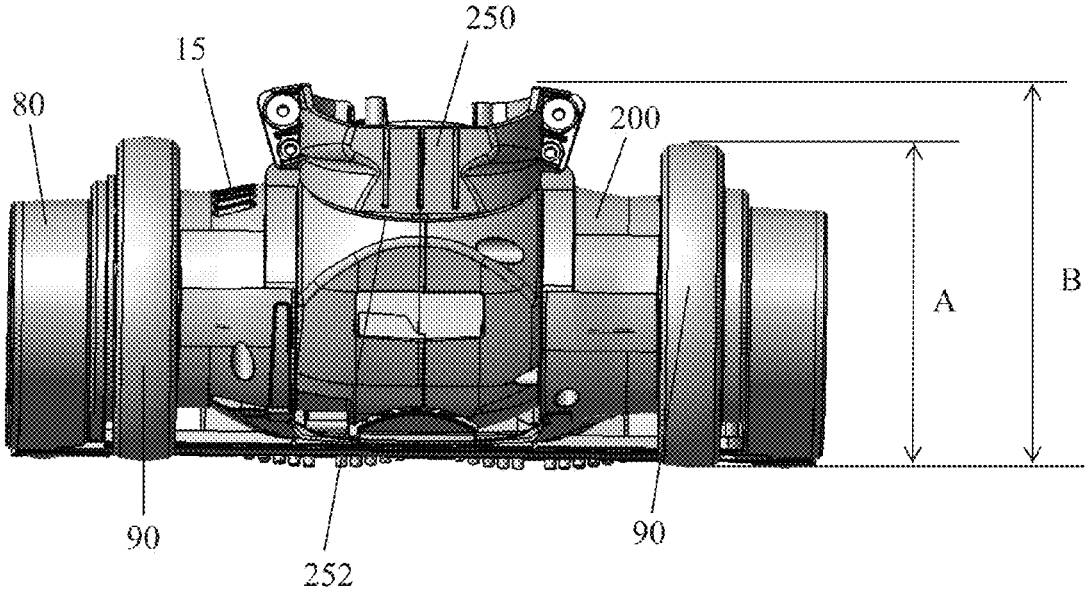
FIG. 13 illustrates a back view of an embodiment of the suction base unit having a wheel height and an overall height.

FIG. 13 illustrates a back view of an embodiment of the suction base unit having a wheel height A and an overall height B, where the wheel height is preferably less that the overall height.

Figure 14:
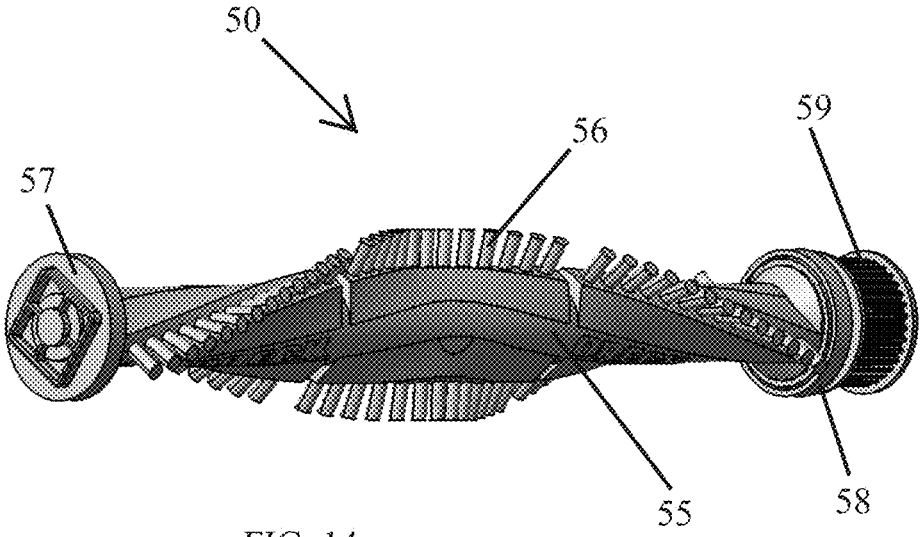
FIG. 14 illustrates an orthogonal view of an embodiment of a brush roll.

FIG. 14 illustrates an orthogonal view of an embodiment of a brush roll 50 having a left support block 57, a right support block 58, a brush roll gear 59 affixed to one end of the brush roll 50, and a plurality of bristles 56 affixed to the brush roll body 55.

References to the "left" and "right" sides of parts and drawings as well as reference of the "front" and "rear" are in reference to a viewer looking from the brush roll cavity towards the swivel joint, where the brush roll cavity is considered to be the front of the suction base unit.

Examples of different particular embodiments of each of the various components and arrangements, as well as different embodiments of the overall cleaning apparatus have been illustrated and described above. The examples illustrate particular combinations of controls and electrical component design features, however other combinations and arrangements of the various inventive features can be implemented, and are intended to be encompassed within the spirit and scope of the present invention. Furthermore, variations and modifications other than those illustrated and described will be apparent to persons of ordinary skill in the art. It is intended that all such embodiments, examples, variations, combinations, and modifications thereon are meant to be encompassed within the spirit and scope of the present invention as set forth in the following claims.

What is claimed is:

1. A light-weight suction base unit for an upright cleaning apparatus that comprises:

a suction base body;

a wheel at least partially supporting the suction base body;

an electric motor mounted within the suction base body such that a portion of the electric motor sits within an annular opening in the wheel;

a left base support operatively associated with the suction base body, such that there is a first gap between a portion of the left base support and a portion of the suction base body;

a right base support operatively associated with the suction base body, such that there is a second gap between a portion of the right base support and a portion of the suction base body;

a brush roll cavity body operatively associated with the suction base body to form a brush roll cavity having a brush roll cavity intake and a brush roll cavity discharge opening, the brush roll cavity body having a first end and a second end, wherein a user is permitted to view a surface being cleaned through the first gap and the second gap, and at least one of the left base support and the right base support extends from the wheel to the first end of the brush roll cavity body;

a brush roll mounted within the brush roll cavity;

a brush roll gear operatively associated with the brush roll;

a drive gear affixed to a rotating shaft of the electric motor; and a drive belt that runs from the drive gear attached to the electric motor to the brush roll gear to cause the brush roll to rotate, the drive belt resides outside of the suction base body and at least a portion of the drive belt is covered by the right base support;

wherein the wheel is interposed between the suction base body and the at least one of the left base support and the right base support.

2. The suction base of claim 1, further comprising a rotary hose bracket;

a straight suction conduit having a hose inlet operatively associated and in fluid communication with the brush roll cavity, and a hose outlet operatively associated and in fluid communication with the rotary hose bracket;

a rotary swivel coupling operatively associated with the rotary hose bracket; and a main body junction conduit providing a fluid communication to an upright main housing.

3. The suction base unit of claim 2, which further comprises a swivel joint housing operatively associated with the rotary hose bracket and rotary swivel coupling that provides a rotatable junction between the suction base unit and an upright main housing operatively associated with the rotary swivel coupling to cause the suction base unit to turn left or right in reaction to the upright main housing being tilted in the same direction.

4. The suction base unit of claim 1, which further comprises a rear body cover attached to a lower suction base housing of the suction base body, and covers the electric motor;

wherein the rear body cover has one or more openings to vent warm air from the inside of the suction base body.

5. The suction base unit of claim 4, which further comprises a controller printed circuit board (PCB) mounted within the suction base body that is electrically connected and transmits power to the electric motor; and a micro-switch mounted within the suction base body that is electrically connected to the PCB over an electrical path, wherein the micro-switch has an actuator positioned to engage a corresponding face of the swivel joint housing, such that the face of the swivel joint housing triggers the micro-switch actuator to signal the PCB over the electrical path to interrupt the transmission of power to the electric motor, when the swivel joint is in the fully upright position.

6. The suction base unit of claim 5, which further comprises annular openings in the rotary swivel coupling and a rotary hose bracket, wherein the openings are aligned to allow wiring from the PCB to run alongside the air path.

7. The suction base unit of claim 1, wherein the wheel is a first wheel and wherein the suction base further includes a second wheel that at least partially supports the suction base body, and wherein the left base support extends from the first wheel to the first end of the brush roll cavity body and the right base support extends from the second wheel to the second end of the brush roll cavity body.

8. The suction base unit of claim 1, wherein the wheel is a first wheel and wherein the suction base further includes a second wheel that at least partially supports the suction base body, and wherein the brush roll has a left end and a right end, and wherein the left base support extends from the first wheel to the left end of the brush roll.

9. The suction base unit of claim 8, wherein the right base support extends from the second wheel to the right end of the brush roll.

10. The suction base unit of claim 1, wherein at least a portion of the wheel extends into one of the first gap and the second gap.

11. The suction base unit of claim 1, wherein the brush roll is rotatably coupled between the first end and the second end of the brush roll cavity body.

* * * * *